United States Patent [19]

Guy et al.

[11] 3,993,242

[45] Nov. 23, 1976

[54] OIL PAINTING COIN BANK

[76] Inventors: Cathy Guy, 4709 McArthur Circle; Judy Hicks, 4612 NE. Dearborn, both of Lawton, Okla. 75301

[22] Filed: July 9, 1975

[21] Appl. No.: 594,336

[52] U.S. Cl. ..... 232/4 R; 46/2

[51] Int. Cl.[2] ..... A47G 29/00

[58] Field of Search ..... 46/2, 3; 229/8.5; 206/.8, .84, .81; 232/4 R, 5, 6

[56] References Cited

UNITED STATES PATENTS

| | | | |
|---|---|---|---|
| 1,456,133 | 5/1923 | Knight | 229/8.5 |
| 1,499,113 | 6/1924 | McNally | 229/8.5 |
| 1,627,822 | 5/1927 | Alexander | 232/4 R |
| 1,704,773 | 3/1929 | Spillane | 229/8.5 |
| 2,156,081 | 4/1939 | Cavalero | 229/8.5 |
| 3,332,616 | 7/1967 | Carter et al. | 232/5 |
| 3,342,407 | 9/1967 | Riegraf | 232/4 R |
| 3,831,313 | 4/1972 | Cichy | 46/2 |

*Primary Examiner*—F. Barry Shay
*Attorney, Agent, or Firm*—Robert R. Keegan

[57] ABSTRACT

There is disclosed a framed oil painting having concealed therein a coin bank in the form of a flexible coin bag wherein the painting canvas is provided with a slot forming a part of the painting subject and arranged to communicate with a corresponding slot in the coin bag; the slot is formed in the upper portion of the painting and the bag is connected to and supported out of contact with the painting canvas so that the painting canvas will not be distorted even when there is a substantial number and bulk of coins in the flexible bag; an access slot is provided at the top rear portion of the bag for removal of coins.

10 Claims, 3 Drawing Figures

OIL PAINTING COIN BANK

The present invention relates to a coin bank formed integrally with a framed oil (or acrylic) painting in a manner such that the only indication of the coin bank purpose of the painting is an unobtrusive slot in the painting canvas preferably located to coordinate with the subject of the painting. For example, the slot may be the mouth of an animal or part of a leaf petal or other portions of a plant. The structure of the picture bank is arranged so that a large number of coins may be contained within the hollow of the stretcher frame and yet the coin bulk is distributed and held away from the canvas to avoid distortion of the painting canvas. If the frame has a thickness about equal to the diameter of a penny, the bank will easily hold coins of a size ranging from a dime to a half dollar.

Coin banks have been integrated with decorative articles of one sort or another in great profusion. In somes cases, the decorative article has included a two-dimensional photograph or other artwork. In general, however, there has been no attempt to conceal or coordinate the coin slot with the pictured subject matter nor has the picture been in the form of a painting on canvas as in the present invention.

The present invention accordingly is much more attractive than the prior articles in that when hung on the wall or otherwise displayed, it gives every appearance of a solely decorative wall painting while at the same time providing an efficient and readily utilized coin bank. As is the case with most coin banks, it may be used for bills when they are properly folded to smaller dimensions. The picture bank according to the present invention does not attract attention to its function which might invite pilfering and, furthermore, is a highly desirable decoration comparable to a purely ornamental oil painting.

Picture banks according to the invention may be manufactured complete or may be provided in the form of a kit to be painted and assembled in greater or lesser degree by the purchaser.

In addition to providing the above features and advantages, it is an object of the present invention to provide a coin bank effectively disguised as an oil painting in which the coin slot is coordinated in the subject matter of the painting and is readily useable without removing the picture from the wall.

It is another object of the present invention to provide an oil painting picture bank in which the oil painting is applied on stretched canvas and the coin container is a flexible bag supported within the stretcher frame in a manner such that coins deposited in the bag will not cause visible bulging or distortion of the canvas.

Other objects and advantages of the invention will be apparent from consideration of the following description in conjunction with the appended drawings in which.

Figure 1:
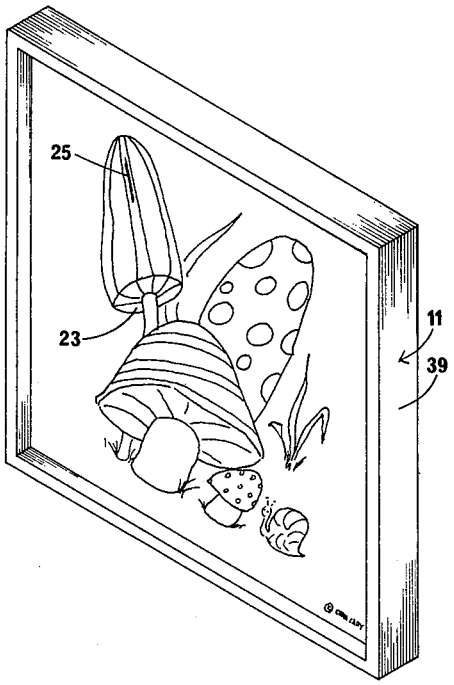
FIG. 1 is a perspective view of an oil painting coin bank according to the present invention.
Figure 3:
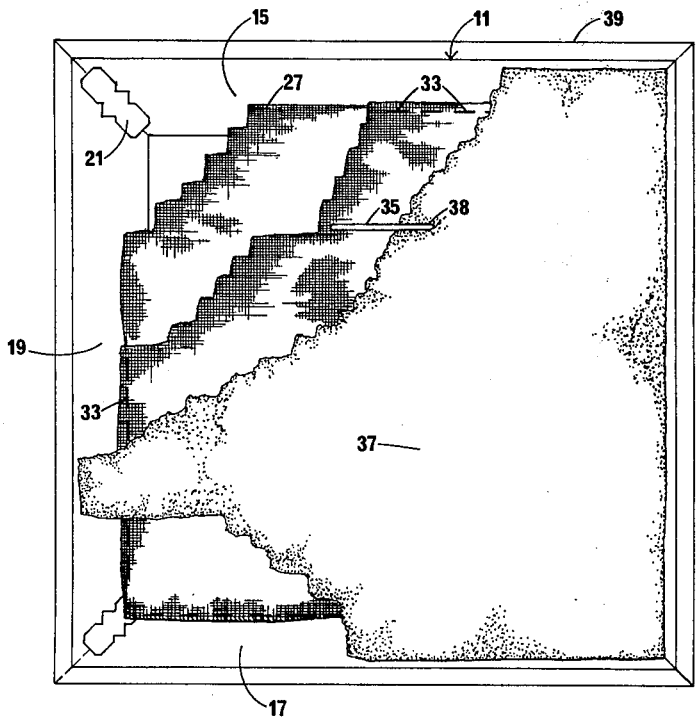
FIG. 3 is a rear elevational view partially broken away, showing the construction of the device of FIGS. 1 and 2.
Figure 2:
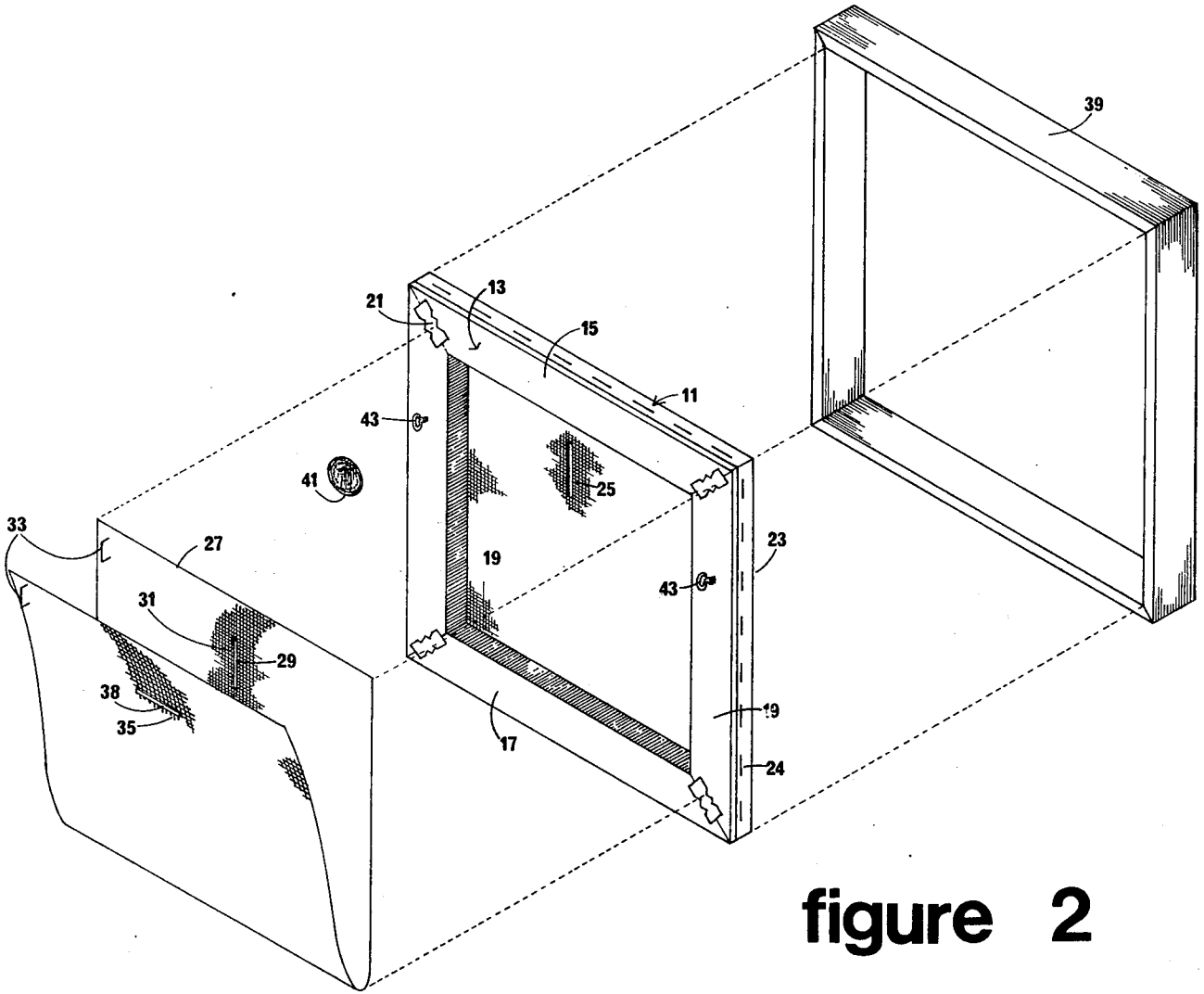
FIG. 2 is an exploded perspective view of the device of FIG. 1 taken from the rear.

Referring now to FIGS. 1–3, the picture bank 11 includes a stretcher frame 13 of the sort on which an oil painting canvas is commonly mounted. The stretcher frame 13 has a top piece 15, a bottom piece 17, and side pieces 19. The pieces 15–19 have mitered corners and are joined together to make the rectangular frame by cleats 21 commonly used for this purpose or by any other suitable means.

A canvas 23 providing a surface for the oil painting is stretched over stretcher frame 13 and secured thereto by any suitable means such as staples 24. Usually, and particularly when an oil painting is painted on canvas 23 by hand, the painting will be done after the canvas is mounted on the stretcher frame. In some cases, the oil painting may be mass produced by a screen printing process and it may be more convenient to mount the canvas 23 on the stretcher 13 after the painting is applied to the canvas.

An opening or slot 25 is cut in canvas 23 to form a coin slot. Slot 25 may be either straight or curved and will preferably be at least large enough to admit a quarter (U.S.) or somewhat larger. Slot 25 may be oriented either vertically or horizontally or obliquely and generally will be coordinated with some feature in the subject matter of the picture on the canvas.

The container for coins is formed of a sheet of flexible material 27. The material 27 may conveniently be formed of canvas or alternatively of woven or nonwoven cloth or plastic sheet material. The material 27 is provided with a slot 29 located to coincide with slot 25. Alternatively, the container could be rigid in part and flexible in part where the slot 29 is located.

In order that a coin inserted in slot 25 will also go through slot 29, the edges of the two slots are secured together. This is preferably done before the material 27 is formed into a bag and may be done by hand or machine sewing the edges of slot 29 and slot 25 to form a single opening through canvas 23 and material 27. It is preferred that the stitching 31 around the edges of slots 25 and 29 be as inconspicuous as possible. This is facilitated by painting over such stitching on the face of canvas 23, and it may accordingly be desired to accomplish the stitching before the painting is painted on the face of canvas 23.

Further steps in assembling the coin bank may also be performed before painting on the face of 23 as will be indicated below.

Material 27 is secured in the interior stretcher frame 13 by folding the material to commence the formation of a bag and fastening the two thicknesses at the top rear portion of the stretcher frame (along piece 15). It is important that the top of the bag formed from material 27 be supported from the rear of the stretcher frame since this avoids having the bulk of a large number of coins press against the flexible canvas 23 and form a bulge or distortion which would be noticeable.

The completion of the bag formed from material 27 may be accomplished by stapling the sides of material 27 to piece 19. The bottom of the material 27 may also be stapled to piece 17 although this is not necessary to complete the formation of the bag since the bottom of material 27 is folded over as seen especially in FIG. 2.

If the construction described above is used, the material 27 after folding should form a rectangle which is slightly larger on every side than the interior dimension of the stretcher frame 13.

Alternatively, the material 27 may be somewhat smaller than the stretcher frame 13, and the sides of the bag formed of material 27 may be closed by stitching the material together. In such case, the bottom of the bag may or may not be lightly tacked by staples or otherwise to stretcher frame piece 17. A somewhat greater number of coins can be accommodated in the bag if the material 27 is stitched on the sides rather than being fastened around the edges of the stretcher frame 13.

The rear top portion of the bag formed of material 27 is provided with a slot 35, preferably oriented horizontally. Slot 35 may be reinforced by stitching if desired. The slot 35 is provided for removing coins from the bank and should be preferably 2 to 3 inches wide thereby permitting the insertion of one's finger to open the slot and aid in the removal of coins. The rear of the picture bank will normally not be exposed to view, and it is not essential to conceal the bag formed of material 27. However, to enhance the appearance of the article, a cover 37 of felt or other suitable material may be fastened over the back of the stretcher frame. This may be accomplished by cementing the cover 37 to the stretcher frame thereby concealing material 27 and staples 33 as well as cleats 21. A slot 38 is provided in cover 37 which may have its edges cemented to the edges of slot 35 in material 27 to form in effect a single opening.

The stretcher frame 13 and associated elements previously described are mounted in a frame 39 in a conventional manner. If desired, the frame 39 may also be assembled with glue and/or nails directly to stretcher frame 13 to provide additional strength and rigidity for the frame 39. Screw eyes 43 and picture wire (not shown) may be attached to the frame 39 in a conventional manner to permit the frame to be hung on the wall from a nail or a picture hook. Alternatively, other conventional picture frame hanging fixtures may be employed to provide means for hanging the picture bank on the wall. Of course, the picture bank may also be provided with an easel for standing it on a flat surface such as a table in lieu of hanging it on the wall.

As previously mentioned, the picture forming the front surface of the picture bank is preferably a painting executed in oil or acrylic on canvas material, or at least a simulation of such a painting. There are limitless possibilities for the subject matter of a picture in which the coin slot may be cleverly concealed. For example, a picture intended for a child's room might have the slot arranged as the mouth of an animal or between the petals of a flower. As an optional feature, the coin slot may be provided with a small zipper which is opened to insert coins in the bank. The zipper could, for example, be employed as the mouth of an animal also, or as a zipper on the pillow of a sleeping child, or the zipper of a jacket of a child or other person.

While the material in which the painting is executed is preferably artist's canvas, it may alternatively be other natural or synthetic woven fabric, nonwoven fabric, or plastic sheet material; in the latter case, the plastic sheet material may have a texture simulating artist's canvas.

The most attractive pictures have been found to be those executed by hand. This may be accomplished more rapidly by the use of stencils or other known techniques. Alternatively, the picture may be applied to the canvas by a screen printing process or by photographic processes which are capable of producing photographic reproductions with a canvas texture.

A rectangle form of a picture has been illustrated for simplicity; but, of course, the picture may take other shapes such as a polygon, circle, or oval.

It is contemplated that generally the entire finished product including the frame will be supplied together; but, of course, the picture mounted on its stretcher frame may be mounted as any other oil or acrylic painting in a general purpose picture frame. Thus, only the picture may be provided, leaving the purchaser to select a frame of his or her own choice.

The method of assembly of the article has been described generally, but it should be pointed out that it is preferred that certain steps be accomplished before certain other steps.

A typical procedure would be to construct a stretcher frame of the desired size; cut the canvas slightly larger than the stretcher frame; outline the proposed picture on the canvas; cut the fabric for the coin bank; cut the coin slot through the picture canvas and the coin bank; stitch the slot edges of the picture canvas and coin bank respectively to one another; stretch the picture canvas on the stretcher frame; partially or fully secure the coin bag in the stretcher frame; paint the picture on the picture canvas; and, after the picture is dry, complete the remainder of the article.

In the above procedure, if a zipper was to be used, it would be stitched into the slot with the usual zipper installation procedure prior to painting the picture; thus any exposed portion of the zipper tape would be painted at the same time the picture is painted.

If desired, the slots of the coin bag and picture canvas may be secured together by stitching or the like after the picture is applied to the canvas. This might be essential in cases where the picture was not handpainted. In such case, the stitching may be touched up to match the picture and reduce its visibility. Alternatively, the edges of the coin slots in the picture canvas and coin bag may be secured together with an adhesive, preferably a clear and colorless one. The quality and durability may, however, be inferior to that which employs stitching (the stitching may be done either by hand or by machine).

In addition to the variations and modifications described and suggested above, numerous other variations and modifications will be apparent to those skillied in the art, and accordingly the scope of the invention is not to be deemed to be limited to the specific embodiments described, but is rather to be determined by reference to the appended claims.

What is claimed is:

1. A coin bank comprising an open frame, a flexible sheet material fastened to cover the opening on the front of said frame; said sheet material having an elongated opening therein to permit the insertion of a coin through said sheet material and a decorative illustration on the front surface thereof; and a coin container formed at least in part of flexible material having an opening therein said container being supported within said frame from the upper portion thereof in spaced apart relation to said sheet material and with its opening maintained substantially coincident with the opening in said sheet material, said container further having aperture means for permitting removal of coins from said container other than through said openings.

2. A coin bank as claimed in claim 1 wherein the edges of said opening in said flexible material are attached to the edges of said opening in said sheet material.

3. Apparatus as claimed in claim 1 wherein said open frame is rectangular in shape and is formed of four rigid side pieces, each with a thickness about equal to its width.

4. A coin bank comprising an open stretcher frame having a thickness approximately equal to the diameter of a United States one cent coin; a flexible sheet material having a canvas-like front surface secured to the sides of said frame; said sheet material having an elongated opening therein suitable for the insertion of a coin through said opening and a decorative illustration on the front surface of said sheet material, said opening forming a part of said decorative illustration; a coin container formed of flexible material supported within said frame from the upper portion thereof and having an opening coinciding with the opening in said sheet material; and means for attaching at least the edges of the opening in said flexible material to the edges of the opening in said sheet material to cause a coin inserted in said sheet material to also pass through said flexible material and into said container.

5. A wall decoration coin bank comprising an open stretcher frame having a thickness approximately equal to the diameter of a United States one cent coin; a sheet material having a canvas-like front surface stretched over the front of said stretcher frame and secured to the outer edges thereof; an ornamental frame surrounding said stretcher frame and concealing the edges of said sheet material, said sheet material having an elongated opening therein suitable for the insertion of a coin through said opening and a decorative illustration on the front surface of said sheet material, said opening forming a part of said decorative illustration; a coin container formed at least in part of flexible material connected to and supported from the upper portion of the back of said stretcher frame and having an opening in the flexible material portion coinciding with the opening in said sheet material; means for attaching at least the edges of the opening in said flexible material to the edges of the opening in said sheet material to cause a coin inserted in said sheet material to also pass through said flexible material and into said container; means attaching the lower portion of said container to the lower portion of said stretcher frame; and a cover secured to the back of said stretcher frame concealing said container, said cover and container having cooperating aperture means for permitting removal of coins from said container.

6. A coin bank as claimed in claim 5 wherein said means for attaching the edges of the openings in said flexible material and said sheet material includes stitching.

7. Apparatus as claimed in claim 6 wherein said stretcher frame is rectangular in shape and is formed of four wooden side pieces, each having a substantially similar rectangular cross section.

8. A coin bank comprising an open frame; a flexible sheet material having a canvas-like front surface secured over the opening on the front of said frame; said sheet material having an elongated opening therein spaced from the top of said frame and suitable for the insertion of a coin through said elongated opening and having a decorative illustration on the front surface thereof, said opening forming a part of said decorative illustration; a coin container bag formed of flexible material supported from the upper portion of said frame and fitting therewithin and having an opening coinciding with the opening in said flexible sheet material; and means for attaching at least the edge of the opening in said flexible material to the edge of the opening in said sheet material to cause a coin inserted in said sheet material to also pass through said flexible material and into said container whereby the weight of the coin is supported from the upper portion of said frame.

9. A coin bank comprising an open frame; a flexible sheet material having a canvas-like front surface secured over the opening on the front of said frame; said sheet material having an elongated opening therein spaced from the top of said frame and suitable for the insertion of a coin through said elongated opening and having a decorative illustration on the front surface thereof, said opening forming a part of said decorative illustration; a coin container bag formed of flexible material supported from the upper portion of said frame and fitting therewithin and having an opening coinciding with the opening in said flexible sheet material; said container further having aperture means permitting removal of coins from said container other than through said elongated opening; and means for attaching at least the edge of the opening in said flexible material to the edge of the opening in said sheet material to cause a coin inserted in said sheet material to also pass through said flexible material and into said container whereby the weight of the coin is supported from the upper portion of said frame.

10. A coin bank as claimed in claim 9 wherein said means for attaching the edges of the opening in said flexible material and sheet material includes stitching.

* * * * *